US012808017B2

(12) United States Patent
Miyahara et al.

(10) Patent No.: US 12,808,017 B2
(45) Date of Patent: Nov. 24, 2026

(54) COPPER ALLOY SHEET MATERIAL AND METHOD FOR PRODUCING THE COPPER ALLOY SHEET MATERIAL

(71) Applicant: DOWA METALTECH CO., LTD., Tokyo (JP)

(72) Inventors: Ryosuke Miyahara, Tokyo (JP); Tomohiro Kawakami, Tokyo (JP); Yuta Sasai, Tokyo (JP); Tomotsugu Aoyama, Tokyo (JP); Hiroto Narieda, Tokyo (JP)

(73) Assignee: DOWA METALTECH CO., LTD., Tokyo (JP)

( * ) Notice: Subject to any disclaimer, the term of this patent is extended or adjusted under 35 U.S.C. 154(b) by 515 days.

(21) Appl. No.: 18/554,884

(22) PCT Filed: Jun. 21, 2022

(86) PCT No.: PCT/JP2022/024700

§ 371 (c)(1),
(2) Date: Oct. 11, 2023

(87) PCT Pub. No.: WO2023/276780

PCT Pub. Date: Jan. 5, 2023

(65) Prior Publication Data

US 2024/0200169 A1 Jun. 20, 2024

(30) Foreign Application Priority Data

Jun. 28, 2021 (JP) ..... 2021-106678

(51) Int. Cl.
*C22F 1/08* (2006.01)
*C22C 9/02* (2006.01)
*C22C 9/06* (2006.01)

(52) U.S. Cl.
CPC ..... *C22C 9/06* (2013.01); *C22C 9/02* (2013.01); *C22F 1/08* (2013.01)

(58) Field of Classification Search
CPC ..... C22C 1/08; C22F 1/08
See application file for complete search history.

(56) References Cited

U.S. PATENT DOCUMENTS

| | | | | |
|---|---|---|---|---|
| 5,777,259 | A * | 7/1998 | Mennucci | H10W 40/226 257/E23.098 |
| 6,372,061 | B1 * | 4/2002 | Hatano | B21B 3/00 148/432 |
| 2009/0116997 | A1 * | 5/2009 | Watanabe | F28F 21/085 148/412 |
| 2012/0049130 | A1 | 3/2012 | Aoyama et al. | |

FOREIGN PATENT DOCUMENTS

| | | | |
|---|---|---|---|
| JP | 2010-270355 | A | 12/2010 |
| JP | 5260201 | B2 | 8/2013 |
| JP | 2014-077192 | A | 5/2014 |
| JP | 2015-093994 | A | 5/2015 |
| JP | 6270417 | B2 | 1/2018 |
| JP | 2018-016823 | A | 2/2018 |
| JP | 2021-055128 | A | 4/2021 |

OTHER PUBLICATIONS

ISR issued in International Patent Application No. PCT/JP2022/024700, Sep. 13, 2022, translation.
Written Opinion of the ISA issued in WIPO Patent Application No. PCT/JP2022/024700, Sep. 13, 2022, translation.
Extended European Search Report issued in EP Patent Application No. 22832928.0, Aug. 28, 2025.
Anonymous, "Resources: Standards & Properties—Copper & Copper Alloy Microstructures: Coppers", Apr. 23, 2021 (Apr. 23, 2021), XP093303915, Retrieved from the Internet: URL:https://web.archive.org/web/20210423090514/https://www.copper.org/resources/properties/microstructure/coppers.html [retrieved on Aug. 11, 2025].
"Oxygen and Hydrogen in Copper and Copper Alloys", Jan. 1, 2020 (Jan. 1, 2020), XP093303920, Retrieved from the Internet: URL:https://icpms.cz/labrulez-bucket- strapih3hsga3/ONH_836_OH_COPPER_COPPER_ALLOYS203_821_455_14d85aae67.pdf [retrieved on Aug. 11, 2025].

* cited by examiner

*Primary Examiner* — Christopher S Kessler
(74) *Attorney, Agent, or Firm* — GREENBLUM & BERNSTEIN, P.L.C.

(57) ABSTRACT

There is provided a copper alloy sheet material, containing: 0.0005% by mass or more and 0.1% by mass or less of Ni, 0.0005% by mass or more and 0.1% by mass or less of Sn, 100 ppm or less of C, 800 ppm or less of O, 10 ppm or less of H, and 50 ppm or less of Ag, with a balance being Cu and impurities, wherein a total content of Ni and Sn is 0.001% by mass or more and 0.11% by mass or less, and when a content of the impurities is expressed as A to B (ppm) in consideration of a quantitative lower limit of each element (here, A is a total impurity content when a content of elements less than the quantitative lower limit is deemed 0 ppm, and B is a total impurity content when a content of the element less than the quantitative lower limit is deemed the quantitative lower limit of each element), A is 100 or less and B is 250 or less.

8 Claims, No Drawings

COPPER ALLOY SHEET MATERIAL AND METHOD FOR PRODUCING THE COPPER ALLOY SHEET MATERIAL

TECHNICAL FIELD

The present invention relates to a copper alloy sheet material suitable for a highly conductive material and a material for heat dissipating parts, a method for producing the same, and the like.

DESCRIPTION OF RELATED ART

In recent years, with a progress of electrification and automation in fields such as automobiles, properties such as high conductivity, high heat resistance, and high strength are required for a highly conductive material and a heat dissipation material used in these fields. Specifically, for example, oxygen-free copper and tough-pitch copper are conventionally used as materials for heat dissipating parts, but heat resistance is insufficient for products to be soldered (at about 250 to 350° C.), and recrystallization occurs due to heating, resulting in a decrease of strength (according to Hall-Petch relationship). For example, when a copper sheet material is used as a material for a heat dissipating part, and when the heat dissipating part is subjected to heat cycles, the copper sheet material tends to warp, and an entire heat dissipating part is likely to crack, due to decrease of the strength.

In order to solve this problem, for example, Patent document 1 proposes a Cu—Sn—Fe—P copper alloy sheet material in which a small amount of Fe and P are added to a Cu—Sn alloy, to achieve both high conductivity and high heat resistance.

Patent document 2 describes a copper alloy sheet material in which Ag, P, Sn, Fe, Ni, etc., are added to Cu and its thermal expansion and contraction in a direction parallel to rolling is adjusted to a predetermined value, as a copper alloy sheet material having high strength, high conductivity and excellent stress relaxation property.

PRIOR ART DOCUMENT

Patent Document

[Patent Document 1] Japanese Patent Publication No. 5260201

[Patent Document 2] Japanese Patent Publication No. 6270417

SUMMARY OF THE INVENTION

Problem to be Solved by the Invention

Copper alloy sheet (materials) disclosed in Patent documents 1 and 2 have such an excellent heat resistance that a strength does not substantially decrease even when heated to about 350° C.

In addition to a soldering described in the related art, there is a product such as an electronic device that undergoes brazing, etc., (performed at about 450 to 800° C.), and when a copper material such as oxygen-free copper is used for such an electronic device, high-temperature heating such as brazing causes progress of recrystallization (even more than when heated to about 350° C. such as soldering), thereby further coarsening the crystal grains and further decreasing the strength. Moreover, the crystal grains are oriented in different crystal orientations, and when the crystal grains are small, the difference in light reflection due to the difference in crystal orientation cannot be recognized by a naked eye, and the copper alloy sheet (material) appears to have a uniform color tone and looks glossy as a whole. However, when the crystal grains become larger to a certain extent (approximately 100 μm as a crystal grain size) or more due to the coarsening, the difference in light reflection becomes recognizable, and an appearance of the copper alloy sheet (material) becomes poor.

The copper alloy sheet (materials) disclosed in Patent documents 1 and 2 do not have large crystal grains even when subjected to high-temperature heating such as brazing, and are less likely to have decreased strength or poor appearance. In addition, as described above, even when heated to about 350° C., the strength is unlikely to decrease, and a heat resistance is maintained to be excellent.

However, these copper alloy sheet (materials) have insufficient conductivity, thus not satisfying a recent demand.

Therefore, an object of the present invention is to provide an inexpensive copper alloy sheet material which is excellent in heat resistance, does not allow crystal grains to be large beyond a certain level even when subjected to high-temperature heating, and is further excellent in conductivity, so as to be comparable to a conventional technique, and to provide a related technique thereof.

Means for Solving the Problem

The present invention has been made under the circumstance described above. In order to solve the above-described problem, intensive research is performed by the present inventors, and it is found that by adding a small amount of Ni and Sn to Cu and setting the amounts of C, O, H, Ag and impurities to a predetermined amount or less, it is possible to obtain an inexpensive copper alloy sheet material that is excellent in heat resistance, does not allow crystal grains to be large beyond a certain level even when subjected to high-temperature heating, and excellent in conductivity. Thus, the present invention is completed. It is also found by the present inventors that when a small amount of S is added to the copper alloy sheet material, the crystal grains are less likely to become particularly large even when subjected to high-temperature heating, and a suitably small grain size can be maintained.

That is, in order to solve the above-described problem, first invention provides a copper alloy sheet material, containing 0.0005% by mass or more and 0.1% by mass or less of Ni, 0.0005% by mass or more and 0.1% by mass or less of Sn, 100 ppm or less of C, 800 ppm or less of O, 10 ppm or less of H, and 50 ppm or less of Ag, with a balance being Cu and impurities, wherein a total content of the Ni and the Sn is 0.001% by mass or more and 0.11% by mass or less, and when a content of the impurities are expressed as A to B (ppm) in consideration of a quantitative lower limit of each element (here, A is a total impurity content when a content of an element less than the quantitative lower limit is deemed 0 ppm, and B is a total impurity content when a content of the element less than the quantitative lower limit is deemed the quantitative lower limit of each element), A is 100 or less and B is 250 or less.

Second invention provides the copper alloy sheet material according to the first invention, containing 1 to 50 ppm of S.

Third invention provides the copper alloy sheet material according to the first invention or the second invention, wherein conductivity of the copper alloy sheet material is 92 to 102% IACS.

Fourth invention provides the copper alloy sheet material according to any one of the first to third inventions, wherein an average crystal grain size of the copper alloy sheet material is 1 to 30 μm.

Fifth invention provides the copper alloy sheet material according to any one of the first to fourth inventions, wherein a ratio ($HV_1/HV_0$) of Vickers hardness $HV_1$ after holding the copper alloy sheet material at 350° C. for 5 minutes in the atmosphere, with respect to Vickers hardness $HV_0$ of the copper alloy sheet material before holding, is 0.80 or more.

Sixth invention provides the copper alloy sheet material according to any one of the first to fifth inventions, wherein the copper alloy sheet material has an average crystal grain size of 100 μm or less after being held at 800° C. for 1 hour.

Seventh invention provides a method for producing a copper alloy sheet material, including:

applying hot-rolling to a copper alloy; then, applying cold-rolling to the copper alloy;

applying recrystallization-annealing to the cold-rolled copper alloy; then, applying final cold-rolling to the copper alloy, the copper alloy containing: 0.0005% by mass or more and 0.1% by mass or less of Ni, 0.0005% by mass or more and 0.1% by mass or less of Sn, 100 ppm or less of C, 800 ppm or less of O, 10 ppm or less of H, and 50 ppm or less of Ag, with a balance being Cu and impurities, wherein a total content of the Ni and the Sn is 0.001% by mass or more and 0.11% by mass or less, and when a content of the impurities is expressed as A to B (ppm) in consideration of a quantitative lower limit of each element (here, A is a total impurity content when a content of an element less than a quantitative lower limit is deemed 0 ppm, and B is a total impurity content when a content of the element less than the quantitative lower limit is deemed the quantitative lower limit of each element), A is 100 or less and B is 250 or less.

Eighth invention provides a heat dissipating part in which the copper alloy sheet material any one of the first to sixth inventions is used.

Nineth invention provides an electronic part in which the copper alloy sheet material according to any one of the first to sixth inventions is bonded to an insulating substrate.

Advantage of the Invention

The copper alloy sheet material according to the present invention is inexpensive, is further excellent in heat resistance, does not allow crystal grains to be large beyond a certain level even when subjected to high-temperature heating, and is also further excellent in conductivity, so as to be comparable to a conventional technique.

DETAILED DESCRIPTION OF THE INVENTION

A copper alloy sheet material according to the present invention will be described in an order of [1] Composition, [2] Physical property and properties, [3] Method for producing a copper alloy sheet material, [4] Evaluation method, [5] Electronic part in which the copper alloy sheet material is used.

[1] Composition

As a composition, the copper alloy sheet material according to the present invention contains 0.0005% by mass or more and 0.1% by mass or less of Ni (nickel), 0.0005% by mass or more and 0.1% by mass or less of Sn (tin), 100 ppm or less of C (carbon), 800 ppm or less of O (oxygen), 10 ppm or less of H (hydrogen), and 50 ppm or less of Ag (silver), with a balance being Cu (copper) and impurities, wherein when a content of impurities is expressed as A to B (ppm) in consideration of a quantitative lower limit of the measuring device, A is 100 or less, B is 250 or less, and a total content of Ni and Sn is 0.001% by mass or more and 0.11% by mass or less. Also, this copper alloy sheet material may contain 1 to 50 ppm of S (sulfur) as an impurity.

The effects and contents of Ni, Sn, other components such as C, and impurities contained in the copper alloy sheet material according to the present invention will be described below in an order of (1) Ni, (2) Sn, (3) total content of Ni and Sn, (4) C, (5) O and H, (6) Ag, (7) impurities, and (8) S.

(1) Ni (nickel)

Ni is an element that forms a solid solution in a Cu matrix and contributes to improving the strength, elasticity, heat resistance, and effect of suppressing grain growth of the copper alloy sheet material. In the present invention, by containing a predetermined amount of Ni together with Sn, the heat resistance of the copper alloy sheet material is significantly increased, and the effect of preventing the crystal grains from becoming larger than a certain level even when subjected to high-temperature heating is exhibited. With the Ni content of 0.0005% by mass or more, the effect can be exhibited. From the viewpoint of exhibiting this effect, the Ni content in the copper alloy sheet material is required to be 0.0005% by mass or more, preferably 0.001% by mass or more, more preferably 0.002% by mass or more, and most preferably 0.003% by mass or more. On the other hand, if the Ni content in the copper alloy sheet material is excessive, the conductivity tends to decrease. From the viewpoint of conductivity, the Ni content is required to be 0.1% by mass or less, preferably 0.07% by mass or less, more preferably 0.05% by mass or less, and most preferably 0.03% by mass or less.

(2) Sn (Tin)

Sn is an element that exhibits a large solid-solution strengthening effect in the copper alloy sheet material. In the present invention, by containing a predetermined amount of Sn together with Ni, the heat resistance of the copper alloy sheet material is greatly improved, and the effect of preventing the crystal grains from becoming larger than a certain level even when subjected to high-temperature heating is exhibited. It can be considered that this is because Ni and Sn form a Cottrell atmosphere, fix dislocations in the copper alloy sheet material, and suppress grain growth when heated. With the Sn content of 0.0005% by mass or more in the copper alloy sheet material, the above effect can be exhibited. From the viewpoint of exhibiting this effect, the Sn content in the copper alloy sheet material is required to be 0.0005% by mass or more, preferably 0.001% by mass or more, more preferably 0.002% by mass or more, and most preferably 0.003% by mass or more. On the other hand, if the Sn content in the copper alloy sheet material is excessive, the conductivity tends to decrease. From the viewpoint of conductivity, the Sn content is required to be 0.1% by mass or less, preferably 0.07% by mass or less, more preferably 0.05% by mass or less, and most preferably 0.03% by mass or less.

(3) Total Content of Ni and Sn

From the viewpoint that Ni and Sn described above form a Cottrell atmosphere and work together to fix dislocations in the copper alloy sheet material to suppress grain growth when heated, and from a viewpoint of conductivity, a total content of Ni and Sn in the copper alloy sheet material is 0.001% by mass or more and 0.11% by mass or less. From the same viewpoint, the total content is preferably 0.003% by mass or more and 0.07% by mass or less, more preferably 0.005% by mass or more and 0.05% by mass or less. From the viewpoint of heat resistance, the total content is preferably 0.0215% by mass or more.

(4) C (Carbon)

C may be mixed in from the raw materials during production, flux, etc., in a melting step when producing the copper alloy sheet material. If the C content exceeds 100 ppm, a minimum bending workability as a copper alloy sheet material cannot be ensured, and cracks occur during processing into electronic parts, which is not preferable. Therefore, the C content in the copper alloy sheet material of the present invention is 100 ppm or less, preferably 80 ppm or less, more preferably 60 ppm or less, and most preferably 50 ppm or less. C may not be contained in the copper alloy sheet material (C content may be less than a quantitative lower limit (not detected) when measured with a quantitative apparatus).

(5) O (Oxygen) and H (Hydrogen)

O and H are also mixed in from the raw materials during production and the atmosphere in the melting step. If the O and H content is large, blowholes and blisters will occur in the copper alloy sheet material, and a minimum bending workability of the copper alloy sheet material cannot be ensured. Therefore, the O content is 800 ppm or less, more preferably 300 ppm or less, more preferably 200 ppm or less, most preferably 100 ppm or less. The H content is 10 ppm or less, more preferably 6 ppm or less, still more preferably 4 ppm or less, and most preferably 2 ppm or less. O and H may not be contained in the copper alloy sheet material (On and H content may be less than the quantitative lower limit (not detected) when measured with a quantitative apparatus).

(6) Ag (Silver)

Ag is often contained in a small amount in the copper raw material, and with such a small amount, the conductivity of the copper alloy sheet material does not decrease, and also the effect of suppressing the growth of crystal grains when heated is exhibited. However, Ag is more expensive than Cu, Ni, and Sn, and therefore further addition of Ag in addition to the mixture from the copper raw materials is not required, because sufficient grain growth suppression effect is exhibited due to presence of Ni and Sn. Therefore, in the copper alloy sheet material of the present invention, the Ag content is 50 ppm or less. The content is more preferably 45 ppm or less, still more preferably 40 ppm or less, and most preferably 30 ppm or less. Ag may not be contained in the copper alloy sheet material (Ag content may be less than the quantitative lower limit (not detected) when measured with a quantitative apparatus).

(7) Impurities

The copper alloy sheet material according to the present invention may contain impurities other than Ni, Sn, C, O, H, Ag and Cu (in the present invention, "impurities" do not include Ni, Sn, C, O, H, Ag and Cu). Examples of the impurities include: unavoidable impurities mixed in the copper alloy sheet material from the raw materials, etc., during production, and a small amount of additive element added with an intention of imparting or improving some function (other than conductivity). As a total content of these elements increases, the conductivity of the copper alloy sheet material decreases. In the present invention, the impurities also include S described in (8) below. In the copper alloy sheet material according to the present invention, the content of the impurities (the total content of the impurity elements) is required to be 100 ppm or less, from the viewpoint of achieving high conductivity.

In the quantification of various elements, the measuring device has a quantitative lower limit. Therefore, for example, when element X in the copper alloy sheet material is measured with the measuring device whose quantitative lower limit is 10 ppm and a measurement result shows "not detected", the content of the element X in the copper alloy sheet material is 0 to 10 ppm (strictly speaking, an end value of 10 ppm is not included). Further, when there are 50 undetected (impurity) elements measured with the measuring device whose quantitative lower limit is 1 ppm, the total content of them is 0 to 50 ppm (strictly speaking, an end value of 50 ppm is not included). In the present invention, the content of the impurities is expressed in a range of A to B (ppm) in consideration of the quantitative lower limit of the measuring device, wherein A is a total impurity content when the content of (undetected) elements less than the quantitative lower limit is deemed 0 ppm, and B is a total impurity content when the content of (undetected) elements less than the quantitative lower limit is deemed the quantitative lower limit of each element.

Regarding the content of the impurities in the copper alloy sheet material of the present invention, A is 100 or less and B is 250 or less (B is a numerical value larger than A), from the viewpoint of achieving high conductivity. From a similar viewpoint, A is preferably 90 or less and B is 230 or less, more preferably A is 80 or less and B is 210 or less, still more preferably A is 70 or less and B is 200 or less. A is normally 1 or more and B is normally 80 or more.

Further, after studies by the present inventors, it is found that among impurities, Fe (iron), P (phosphorus), and Si (silicon) have a large adverse effect on the conductivity of the copper alloy sheet material.

From the viewpoint of conductivity, in the copper alloy sheet material, Fe content is preferably 50 ppm or less, more preferably 20 ppm or less, P content is preferably 40 ppm or less, more preferably 15 ppm or less, and Si content is preferably 60 ppm or less, more preferably 25 ppm or less.

As described above, the copper alloy sheet material of the present invention contains copper as a main element, with a low content of expensive silver, and although containing other expensive metal as impurities, an amount of these materials is also suppressed to a small amount to the extent that allows the copper alloy sheet material to ensure sufficient conductivity. This makes the copper alloy sheet material inexpensive.

In the copper alloy sheet material according to the present invention, the impurities (other than Ni, Sn, C, O, H, Ag and Cu) are elements that can be quantified by inductively coupled plasma-mass spectroscopy (ICP-MS, eg 7900 manufactured by Agilent), carbon-sulfur analyzers (eg CS844 model manufactured by LECO), oxygen-nitrogen-hydrogen analyzers (eg ONH-836 manufactured by LECO), and combustion-ion chromatography (eg DIONEX ICS-1600 manufactured by Thermo Scientific). These devices can quantify all elements that can be contained in copper alloy in an amount that can significantly change (decrease) their conductivity.

More specifically, according to the present invention, for example, as the impurities:

N (nitrogen) is quantified by an oxygen/nitrogen/hydrogen analyzer;

S (sulfur) is quantified by a carbon sulfur analyzer, 2 to 6 cycle elements (excluding C, N, O, group 17 elements, group 18 elements, Tc (technetium), Po (polonium), Pm (promethium)) are quantified by ICP-MS, F (fluorine), Cl (chlorine) and Br (bromine) are quantified by a combustion-ion chromatography, and in this quantification, N, F, Na, Si, P, K, Ca, Se, Br, and Cl are quantified by a quantitative apparatus whose quantitative lower limit is 10 ppm; and other elements (Li (lithium), Be (beryllium), B (boron), Mg (magnesium), Al (aluminum), S (sulfur), Sc (scandium), Ti (titanium), V (vanadium), Cr (chromium), Mn (manganese), Fe (iron), Co (cobalt), Zn (zinc), Ga (gallium), Ge (germanium), As (arsenic), Rb (rubidium), Sr (strontium), Y (yttrium), Zr (zirconium), Nb (niobium), Mo (molybdenum), Ru (ruthenium), Rh (rhodium), Pd (palladium), Cd (cadmium), In (indium), Sb (antimony), Te (tellurium), Cs (cesium), Ba (barium), La (lanthanum), Ce (cerium), Pr (praseodymium), Nd (neodymium), Sm (samarium), Eu (europium), Gd (gadolinium), Tb (terbium), Dy (dysprosium), Ho (holmium), Er (erbium), Tm (thulium), Yb (ytterbium), Lu (lutetium), Hf (hafnium), Ta (tantalum), W (tungsten), Re (rhenium), Os (osmium), Ir (iridium), Pt (platinum), Au (gold), Hg (mercury), Tl (thallium), Pb (lead), Bi (bismuth)), are quantified by a quantitative apparatus whose quantitative lower limit is 1 ppm.

(8) S (Sulfur)

S is an optional component (impurity) in the copper alloy sheet material of the present invention, but when added in a small amount, S segregates at grain boundaries of the copper alloy sheet material and exhibits an effect of suppressing grain growth when heated. This effect is considered to exhibit a synergistic effect with the Cottrell atmosphere due to a cooperation of Ni and Sn described above. From the viewpoint of exhibiting the synergistic effect and from the viewpoint of the conductivity of the copper alloy sheet material, the S content in the copper alloy sheet material is preferably 1 to 50 ppm, more preferably 2 to 40 ppm, still more preferably 3 to 30 ppm, and most preferably 4 to 20 ppm.

However, depending on the application of the copper alloy sheet material, containing of S in the copper alloy sheet material may be avoided. In this case, the effect of the present invention can be obtained by the effect of the Cottrell atmosphere produced by the cooperation of Ni and Sn. In this case, S is substantially prevented from being contained in the copper alloy sheet material (not detected when measured with the above-described carbon sulfur analyzer).

[2] Physical Property and Properties

Various physical property and properties of the copper alloy sheet material of the present invention described above will be described below.

(1) Average Crystal Grain Size

An average crystal grain size of the copper alloy sheet material of the present invention is preferably 1 to 30 μm, more preferably 2 to 25 μm, still more preferably 3 to 20 μm, from the viewpoint of strength, good appearance and bending workability.

Further, the copper alloy sheet material of the present invention does not have crystal grains larger than a certain level even when subjected to high-temperature heating as described above. Specifically, after holding the copper alloy sheet material at 800° C. for 1 hour in the atmosphere, the average crystal grain size of the copper alloy sheet material is preferably 100 μm or less, more preferably 80 μm or less, and still more preferably 4 to 50 μm.

(2) Heat Resistance

The copper alloy sheet material of the present invention is excellent in heat resistance. Specifically, the ratio of the Vickers hardness HV after holding the copper alloy sheet material at 350° C. for 5 minutes in the atmosphere (subjected to heat treatment) with respect to the Vickers hardness HV of the copper alloy sheet material before heat treatment ((Vickers hardness $HV_1$ after heat treatment)/(Vickers hardness $HV_0$ before heat treatment)), is preferably 0.80 or more, more preferably 0.82 or more, and still more preferably 0.85 or more (usually 0.98 or less). The Vickers hardness ($HV_0$) of the copper alloy sheet material of the present invention is, for example, 60 to 150.

(3) Conductivity

The copper alloy sheet material of the present invention is excellent in conductivity. Specifically, the conductivity of the copper alloy sheet is preferably 92 to 102% IACS, more preferably 94 to 102% IACS, still more preferably 96 to 102% IACS.

[3] Method for Producing a Copper Alloy Sheet Material

In the production of the copper alloy sheet material according to the present invention, a known general production method may be applied. As an example of the production method, a method for producing a copper alloy sheet material will be explained for each step of: (1) Melting-casting, (2) Heat treatment, (3) Hot-rolling, (4) Cold-rolling, (5) Recrystallization-annealing, (6) Final cold-rolling, (7) Low temperature annealing.

(1) Melting-Casting

This is a step of mixing a predetermined amount of each component of the copper alloy sheet material according to the present invention, melting the mixture, and casting an ingot. As the melting step, there are a melting method in the atmosphere, a melting method in a reducing atmosphere, and a melting method in a vacuum. Among them, any melting method can be employed. After melting the copper alloy raw material, an ingot having a thickness of 10 to 500 mm, for example, is obtained by continuous casting or semi-continuous casting.

(2) Heat Treatment

The heat treatment step is a step of applying heat treatment to the ingot obtained in the melting-casting step described above. This is a step of exhibiting a macro effect of reducing the segregation of elements that occurs during casting by applying heat treatment to the ingot at a temperature of preferably 700° ° C. to 1000° C. for 30 minutes to 10 hours.

(3) Hot-Rolling

In the hot-rolling step, the ingot is rolled after being softened in a high temperature range of usually 900° C. or higher in the above heat treatment. This is performed for the purpose of exhibiting a micro effect of destroying a cast structure in the ingot by recrystallization during rolling and between roll passes. In this rolling, if the rolling is performed at a high temperature exceeding 950° C., there is a risk of cracking that occurs in an area where a melting point is lowered, such as segregation part of an alloy component. Therefore, in order to suppress cracking, it is preferable to roll at a temperature of 950° C. or less. Further, in order to ensure that the cast structure is completely recrystallized (so-called complete recrystallization) during the hot-rolling step, it is preferable to perform rolling at a reduction ratio of 70% or more (with the above ingot as a reference) in a temperature range of 650 to 950° C., thereby further promoting homogenization of the structure. Rolling at a reduction ratio of less than 70% results in insufficient introduction of strain (dislocation), and complete recrystallization is difficult to achieve. In order to obtain a reduction ratio of 70% or more by one pass, a large rolling load is required. Therefore, it is preferable to ensure 70% or more reduction ratio in total by dividing the rolling into multiple passes.

Further, in the hot-rolling step, in order to promote recrystallization in the subsequent recrystallization-annealing step after rolling in the above temperature range of 650 to 950° C., it is desirable to ensure rolling for a certain period of time in a temperature range of 350° C. or more and less than 650° C. where distortion is likely to occur. Even in this temperature range, multiple roll passes can be performed. In this case, final pass temperature is preferably 350° C. or higher, more preferably 350 to 600° C. The reduction ratio in the temperature range of 350° C. or more and less than 650° C. is preferably 35% or more, more preferably 40% or more.

Further, a total reduction ratio in the hot-rolling including rolling in the temperature range of 350° C. or higher and less than 650° C., may be about 85 to 95%.

(4) Cold-Rolling

Cold-rolling is a rough rolling step to obtain a thin thickness of the ingot that has undergone hot-rolling. Therefore, it is desirable that the reduction ratio is 50% or more. This step is an important step for recrystallization treatment in the next recrystallization-annealing (intermediate annealing) step, and is a step for introducing strain into the ingot that has undergone hot-rolling. The introduced strain serves as a driving force for recrystallization. Then, when the reduction ratio is 50% or more, it is considered that the size of the recrystallized grains becomes suitably uniform in the next recrystallization-annealing step. However, if the reduction ratio exceeds 95%, the end face of the copper alloy sheet may crack and break. Therefore, the reduction ratio is preferably 95% or less.

(5) Recrystallization-Annealing

Recrystallization-annealing is a step of applying heat treatment to a cold-rolled sheet material to recrystallize and soften a structure that has undergone hardening treatment by cold-rolling. The heat treatment is preferably performed at a temperature of 250 to 650° C. for several seconds to several hours. When the temperature is 250° C. or higher, recrystallization proceeds sufficiently. On the other hand, when the temperature exceeds 650° C., the crystal grain size becomes coarse, and the copper alloy sheet material having desired strength may not be obtained.

(6) Final Cold-Rolling

A final cold-rolling is a step performed to convert a recrystallization-annealed sheet material into a copper alloy sheet material having a target thickness and to improve a strength level of the copper alloy sheet material. Depending on a desired strength level, the reduction ratio is adjusted from 0% (without final cold-rolling) to 95%. When the reduction ratio of the final cold-rolling exceeds 95%, the hardening reaches a limit and the strength does not increase, resulting in a sheet material with no elongation, and workability may deteriorate. The thickness of the final copper alloy sheet material is optimized depending on the application, preferably about 0.02 to 6.0 mm, more preferably about 0.04 to 5.0 mm.

(7) Low Temperature Annealing

Low temperature annealing is a step performed as needed, to improve bending workability by decreasing residual stress in the final cold-rolled copper alloy sheet material, and to improve stress relaxation property by reducing vacancies and dislocations on a slip plane in the copper alloy sheet material. The low temperature annealing is preferably performed by applying heat treatment to the copper alloy sheet material at a temperature of 500° C. or less, and more preferably, low temperature annealing is performed at a heating temperature of 150 to 470° C. (preferably a temperature lower than the annealing temperature in the Recrystallization-annealing step described above). Further, the holding time at this heating temperature is preferably 5 seconds or more in terms of stability in a continuous annealing furnace. In a batch type annealing furnace, the holding time is preferably within 10 hours from the viewpoint of a cost.

[4] Evaluation Method

In order to evaluate what kind of properties the copper alloy sheet material of the present invention has, various evaluations were performed in examples described later. Regarding the evaluation method, (1) Measurement of tensile strength and elongation, (2) Measurement of conductivity, (3) Measurement of Vickers hardness, (4) Evaluation of heat resistance by measurement of Vickers hardness, (5) Measurement of average crystal grain size, will be described in this order.

(1) Measurement of Tensile Strength and Elongation

The measurement of tensile strength and elongation is performed as follows: a test piece (JIS Z2201 No. 5 test piece) was taken from the copper alloy sheet material, for testing a tensile strength of LD (direction parallel to rolling direction), and a tensile test was performed in accordance with JIS Z2241 to evaluate a tensile strength and elongation of the LD.

(2) Measurement of conductivity

The conductivity was measured in accordance with a conductivity measurement method of JIS H0505.

The higher the conductivity, the better, but it is desirable that the conductivity is 92% IACS or more.

(3) Measurement of Vickers Hardness

As Vickers hardness, the Vickers hardness $HV_0$ of the copper alloy sheet material was measured, with a test load of 500 gf, in accordance with JIS Z2244.

(4) Evaluation of Heat Resistance by Measurement of Vickers Hardness

The heat resistance of the copper alloy sheet material was evaluated as follows: the copper alloy sheet material was held in an air atmosphere furnace heated to 350° C. for 5 minutes, and removed from the furnace and water-cooled to room temperature, then, the Vickers hardness $HV_1$ was measured and the ratio with respect to $HV_0$ was calculated. $HV_1/HV_0$ is preferably 0.80 or more.

(5) Measurement of an Average Crystal Grain Size

The measurement of an average crystal grain size was performed by a cutting method in accordance with JIS H0501 as follows: a sheet surface (rolled surface) of the copper alloy sheet material is etched after polishing, and the etched surface is observed with an optical microscope to measure the average crystal grain size. The average crystal grain size of the copper alloy sheet is preferably 1 to 30 μm.

Further, the copper alloy sheet material was held in (an atmosphere) furnace heated to 800° C. for 1 hour, taken out from the furnace and water-cooled to room temperature, and then, an average crystal grain size was measured similarly as described above. The average crystal grain size of the copper alloy sheet material after heating is required to be 100 μm or less.

[5] Electronic Part in which the Copper Alloy Sheet Material is Used

Next, an electronic part in which the copper alloy sheet material of the present invention is used, will be described.

As described above, the copper alloy sheet material of the present invention is excellent in heat resistance, does not allow crystal grains to be large beyond a certain level even when subjected to high-temperature heating, and is excellent in conductivity, and is suitable as a highly conductive material and a heat dissipation material. An example of using the copper alloy sheet material as a heat dissipation material is given as an electronic part in which the copper alloy sheet material is brazed to an insulating substrate.

EXAMPLES

Hereinafter, the copper alloy sheet material and the method for producing the same according to the present invention will be specifically described with reference to examples. However, the present invention is not limited to these examples.

Example 1

Ni and Sn were added to high-purity oxygen-free copper (C1011) so that each content in an entire copper alloy raw material after addition was 0.011% by mass. This copper alloy raw material was melted in an Ar atmosphere using a high-frequency melting furnace and cast into an ingot of 40×40×150 (mm).

A test piece of 20t×40w×40l (mm) was cut from the obtained ingot, subjected to heat treatment at 950° C. for 30 minutes for homogenization, and then hot-rolled from 20 mm to 3.6 mm in thickness. In the hot-rolling, rolling was performed at a reduction ratio of 70% in a temperature range of 650 to 950° C., then rolling was performed at a reduction ratio of 40% in a temperature range of 350 to 650° C., and rolling of a final pass was performed at 500° C. After the hot-rolling, the sheet was cold-rolled from 3.6 mm to 1.0 mm in thickness. Next, Recrystallization-annealing was performed at 400° ° C. for 30 minutes, and final cold-rolling was performed until the reduction ratio becomes 50%. Thus, the copper alloy sheet according to example 1 having a thickness of 0.50 mm was finished.

A sample was taken from the copper alloy sheet material according to example 1, and the composition, tensile strength, elongation, conductivity, Vickers hardness, heat resistance, and average crystal grain size were measured.

(1) Composition

As a result of analyzing the composition of the sample taken from the copper alloy sheet material, Ni content was 0.011% by mass, Sn content was 0.011% by mass, C content was 35 ppm, O content was 44 ppm, H content was 1.6 ppm, Ag content was 13 ppm, and 9 ppm of Mg, 3 ppm of Fe, and 10 ppm of Zn were detected as impurities. The content of the detected impurities was 22 ppm in total. Other elements were not detected. Since no elements were added or extracted to/from the above ingot in the production (rolling, etc.) of the copper alloy sheet material, it is considered that the above ingot also had the same composition.

- O and N were quantified by an oxygen/nitrogen/hydrogen analyzer (LECO ONH-836),
- H was quantified by a hydrogen analyzer (Horiba EMGA-921),
- C and S were quantified by a carbon sulfur analyzer (LECO CS844 type),
- 2 to 6 cycle elements (excluding C, N, O, group 17 elements, group 18 elements, Tc (technetium), Po (polonium), Pm (promethium)) were quantified by ICP-MS (Agilent 7900), and
- F, Cl and Br were quantified by a combustion-ion chromatography device (DIONEX ICS-1600 manufactured by Thermo Scientific).

In the above quantification, the quantitative lower limit of C, N, O, F, Na, Si, P, K, Ca, Se, Br, and Cl was 10 ppm, and the quantitative lower limit of other elements was 1 ppm. In the elements that were not detected, the quantitative lower limit of 10 elements was 10 ppm and the quantitative lower limit of 55 elements was 1 ppm. Therefore, the content of the impurities in the copper alloy sheet material (and ingot) was 22 to 177 ppm when expressed in consideration of the quantitative lower limit.

(2) Measurement of Tensile Strength and Elongation

Tensile strength was obtained as follows: a test piece (JIS Z2201 No. 5 test piece) was taken from the copper alloy sheet material, for testing the tensile strength of LD (direction parallel to the rolling direction), to obtain the LD tensile strength and elongation. The result revealed that the LD tensile strength was 393 $N/mm^2$ and an LD elongation was 1.1%.

(3) Measurement of Conductivity

The conductivity of the copper alloy sheet material was 98.1% IACS.

(4) Measurement of Vickers Hardness

The Vickers hardness ($HV_0$) of the copper alloy sheet material was 126.

(5) Evaluation of Heat Resistance by Measurement of the Vickers Hardness

The Vickers hardness ($HV_1$) of the copper alloy sheet material after heating was 119, and $HV_1/HV_0$ was 0.94.

(6) Measurement of an Average Crystal Grain Size

An average crystal grain size of the copper alloy sheet material was 12 μm, and an average crystal grain size after heating at 800° ° C. for 1 hour was 56 μm.

For the copper alloy sheet material according to example 1 described above, conditions in each step of the casting, heating, rolling, and annealing, and measurement results of the alloy composition, tensile strength, elongation, conductivity, Vickers hardness, heat resistance and crystal grain size, are respectively shown in tables 1 and 2 described later. The same applies to examples 2 to 6 below.

Example 2

A copper alloy raw material was prepared, in which Ni was added to high-purity oxygen-free copper (C1011) so that the content in an entire copper alloy raw material after addition was 0.001% by mass, Sn was added thereto so that the content was 0.01% by mass, S was added thereto so that the content was 14 ppm, and this copper alloy raw material was melted in an Ar atmosphere using a high-frequency melting furnace and cast into an ingot of 40×40×150 (mm). Then, a copper alloy sheet material according to example 2 was finished by performing the same operation as in example 1 except for the casting.

The same measurement as in example 1 was performed to the copper alloy sheet material according to example 2. The conditions in each step and measurement results are shown in tables 1 and 2 below.

Example 3

A copper alloy raw material was prepared, in which Ni was added to high-purity oxygen-free copper (C1011) so that the content in an entire copper alloy raw material after addition was 0.01% by mass, Sn was added thereto so that the content was 0.001% by mass, S was added thereto so that the content was 16 ppm, and this copper alloy raw material was melted in an Ar atmosphere using a high-frequency melting furnace and cast into an ingot of 40×40×150 (mm).

Then, a copper alloy sheet material according to example 3 was finished by performing the same operation as in example 1 except that recrystallization-annealing was performed at 400° C. for 2 hours, and low temperature annealing was performed at 250° ° C. for 30 minutes after final cold-rolling.

Then, the same measurement as in example 1 was performed to the copper alloy sheet material according to example 3. The conditions in each step and measurement results are shown in tables 1 and 2 below.

Example 4

A copper alloy raw material was prepared, in which Ni was added to high-purity oxygen-free copper (C1011) so that the content in an entire copper alloy raw material after addition was 0.06% by mass, Sn was added thereto so that the content was 0.01% by mass, S was added thereto so that the content was 9 ppm, and this copper alloy raw material was melted in an Ar atmosphere using a high-frequency melting furnace and cast into an ingot of 40×40×150 (mm).

Then, a copper alloy sheet material according to example 4 was finished by performing the same operation as in example 1 except that a final cold-rolling was performed so that the reduction ratio was 30% and the copper alloy sheet material having a thickness of 0.70 mm was finished.

The same measurement as in example 1 was performed to the copper alloy sheet material according to example 4. The conditions in each step and measurement results are shown in tables 1 and 2 below.

Example 5

A copper alloy raw material was prepared, in which Ni was added to high-purity oxygen-free copper (C1011) so that the content in an entire copper alloy raw material after addition was 0.01% by mass, Sn was added thereto so that the content was 0.05% by mass, S was added thereto so that the content was 16 ppm, and this copper alloy raw material was melted in an Ar atmosphere using a high-frequency melting furnace and cast into an ingot of 40×40×150 (mm).

Then, a copper alloy sheet material according to example 5 was finished by performing the same operation as in example 1 except that a final cold-rolling was performed so that the reduction ratio was 60% and the copper alloy sheet material having a thickness of 0.40 mm was finished.

The same measurement as in example 1 was performed to the copper alloy sheet material according to example 5. The conditions in each step and measurement results are shown in tables 1 and 2 below.

Example 6

A copper alloy raw material was prepared, in which Ni was added to high-purity oxygen-free copper (C1011) so that the content in an entire copper alloy raw material after addition was 0.01% by mass, Sn was added thereto so that the content was 0.01% by mass, S was added thereto so that the content was 48 ppm, and this copper alloy raw material was melted in an Ar atmosphere using a high-frequency melting furnace and cast into an ingot of 40×40×150 (mm).

Then, a copper alloy sheet material according to example 6 was finished by performing the same operation as in example 1 except that cold-rolling was performed so that a reduction ratio was about 58% to obtain a sheet thickness of 1.50 mm, and final cold-rolling was performed so that a reduction ratio was about 67% to obtain a thickness of 0.5 mm.

The same measurement as in example 1 was performed to the copper alloy sheet material according to example 6. The conditions in each step and measurement results are shown in tables 1 and 2 below.

Comparative Example 1

A copper alloy raw material was prepared, in which Ni was not added to high-purity oxygen-free copper (C1011), Sn was added thereto so that the content was 0.02% by mass, S was added thereto so that the content was 12 ppm, and this copper alloy raw material was melted in an Ar atmosphere using a high-frequency melting furnace and cast into an ingot of 40×40×150 (mm). Then, a copper alloy sheet material according to comparative example 1 was finished by performing the same operations as in example 1 except for the casting.

The same measurement as in example 1 was performed to the copper alloy sheet material according to comparative example 1. The conditions in each step and measurement results are shown in tables 3 and 4 below.

Comparative Example 2

A copper alloy raw material was prepared, in which Ni was added to high-purity oxygen-free copper (C1011) so that the content in an entire copper alloy raw material after addition was 0.15% by mass, Sn was added thereto so that the content was 0.01% by mass, S was added thereto so that the content was 12 ppm, and this copper alloy raw material was melted in an Ar atmosphere using a high-frequency melting furnace and cast into an ingot of 40×40×150 (mm). Then, a copper alloy sheet material according to comparative example 2 was finished by performing the same operations as in example 1 except for the casting.

The same measurement as in example 1 was performed to the copper alloy sheet material according to comparative example 2. The conditions in each step and measurement results are shown in tables 3 and 4 below.

Comparative Example 3

A copper alloy raw material was prepared, in which Sn was not added to high-purity oxygen-free copper (C1011), Ni was added thereto so that the content in an entire copper alloy raw material after addition was 0.02% by mass, S was added thereto so that the content was 12 ppm, and this copper alloy raw material was melted in an Ar atmosphere using a high-frequency melting furnace and cast into an ingot of 40×40×150 (mm). Then, a copper alloy sheet material according to comparative example 3 was finished by performing the same operations as in example 1 except for the casting.

The same measurement as in example 1 was performed to the copper alloy sheet material according to comparative example 3. The conditions in each step and measurement results are shown in tables 3 and 4 below.

Comparative Example 4

A copper alloy raw material was prepared, in which Ni was added to high-purity oxygen-free copper (C1011) so that the content in an entire copper alloy raw material after addition was 0.01% by mass, Sn was added thereto so that the content was 0.15% by mass, S was added thereto so that the content was 12 ppm, and this copper alloy raw material was melted in an Ar atmosphere using a high-frequency melting furnace and cast into an ingot of 40×40×150 (mm). Then, a copper alloy sheet material according to comparative example 4 was finished by performing the same operations as in example 1 except for the casting.

The same measurement as in example 1 was performed to the copper alloy sheet material according to comparative example 4. The conditions in each step and measurement results are shown in tables 3 and 4 below.

Comparative Example 5

A copper alloy raw material was prepared, in which Ni was added to high-purity oxygen-free copper (C1011) so that the content in an entire copper alloy raw material after addition was 0.06% by mass, Sn was added thereto so that the content was 0.06% by mass, S was added thereto so that the content was 12 ppm, and this copper alloy raw material was melted in an Ar atmosphere using a high-frequency melting furnace and cast into an ingot of 40×40×150 (mm). Then, a copper alloy sheet material according to comparative example 5 was finished by performing the same operations as in example 1 except for the casting.

The same measurement as in example 1 was performed to the copper alloy sheet material according to comparative example 5. The conditions in each step and measurement results are shown in tables 3 and 4 below.

Comparative Example 6

A copper alloy raw material was prepared, in which Ni was added to high-purity oxygen-free copper (C1011) so that the content in an entire copper alloy raw material after addition was 0.01% by mass, Sn was added thereto so that the content was 0.01% by mass, S was added thereto so that the content was 12 ppm, Fe was added thereto so that the content was 80 ppm, P was added thereto so that the content was 50 ppm, and this copper alloy raw material was melted in an Ar atmosphere using a high-frequency melting furnace and cast into an ingot of 40×40×150 (mm). Then, a copper alloy sheet material according to comparative example 6 was finished by performing the same operations as in example 1 except for casting.

The same measurement as in example 1 was performed to the copper alloy sheet material according to comparative example 6. The conditions in each step and measurement results are shown in tables 3 and 4 below.

Comparative Example 7

A copper alloy raw material was prepared, in which S was not added to high-purity oxygen-free copper (C1011), Ni was added thereto so that the content in an entire copper alloy raw material after addition was 0.003% by mass, Sn was added thereto so that the content was 0.003% by mass, and this copper alloy raw material was melted in an Ar atmosphere using a high-frequency melting furnace and cast into an ingot of 40×40×150 (mm). Then, a copper alloy sheet material according to comparative example 7 was finished by performing the same operations as in example 1 except for the casting.

The same measurement as in example 1 was performed to the copper alloy sheet material according to comparative example 7. The conditions in each step and measurement results are shown in tables 3 and 4 below.

TABLE 1

| | | Example 1 | Example 2 | Example 3 | Example 4 | Example 5 | Example 6 |
|---|---|---|---|---|---|---|---|
| Production method | Casting | High-frequency melting furnace | High-frequency melting furnace | High-frequency melting furnace | High-frequency melting furnace | High-frequency melting furnace | High-frequency melting furnace |
| | Thickness of test piece | 20 mm | 20 mm | 20 mm | 20 mm | 20 mm | 20 mm |
| | Heating | 950° C. | 950° C. | 950° C. | 950° C. | 950° C. | 950° C. |
| | Hot-rolling (thickness after rolling, reduction ratio) | 3.6 mm, 82% | 3.6 mm, 82% | 3.6 mm, 82% | 3.6 mm, 82% | 3.6 mm, 82% | 3.6 mm, 82% |
| | Cold-rolling (thickness after rolling, reduction ratio) | 1 mm, 72% | 1 mm, 72% | 1 mm, 72% | 1 mm, 72% | 1 mm, 72% | 1.5 mm, 58% |
| | Recrystallization-annealing | 400° C. × 30 min | 400° C. × 30 min | 400° C. × 2 h | 400° C. × 30 min | 400° C. × 30 min | 400° C. × 30 min |
| | Final cold-rolling (thickness after rolling, reduction ratio) | 0.5 mm, 50% | 0.5 mm, 50% | 0.5 mm, 50% | 0.7 mm, 30% | 0.4 mm, 60% | 0.5 mm, 67% |
| | Low temperature annealing | None | None | 250° C. × 30 min | None | None | None |

TABLE 2

| | | | Example 1 | Example 2 | Example 3 | Example 4 | Example 5 | Example 6 |
|---|---|---|---|---|---|---|---|---|
| Alloy composition of copper alloy sheet | Cu | (mass %) | Balance | Balance | Balance | Balance | Balance | Balance |
| | Ni | (mass %) | 0.0110 | 0.0010 | 0.0100 | 0.0600 | 0.0100 | 0.0100 |
| | Sn | (mass %) | 0.0110 | 0.0100 | 0.0010 | 0.0100 | 0.0500 | 0.0100 |
| | Ni + Sn | (mass %) | 0.0220 | 0.0110 | 0.0110 | 0.0700 | 0.0600 | 0.0200 |

TABLE 2-continued

| | | | | Example 1 | Example 2 | Example 3 | Example 4 | Example 5 | Example 6 |
|---|---|---|---|---|---|---|---|---|---|
| material | C | | (ppm) | 35 | 28 | 16 | 21 | 10 | 15 |
| | O | | (ppm) | 44 | 35 | 38 | 31 | 35 | 42 |
| | H | | (ppm) | 1.6 | 1.2 | 1.4 | 1.5 | 1.1 | 1.5 |
| | Ag | | (ppm) | 13 | 10 | 12 | 15 | 12 | 8 |
| | Impurities ※1 | S | (ppm) | Not detected | 12 | 15 | 8 | 14 | 45 |
| | | Mg | (ppm) | 9 | Not detected | 2 | 8 | Not detected | Not detected |
| | | Fe | (ppm) | 3 | 10 | Not detected | 5 | 2 | Not detected |
| | | Zn | (ppm) | 10 | Not detected | 20 | Not detected | Not detected | Not detected |
| | | Si | (ppm) | Not detected | Not detected | 3 | 6 | 13 | 1 |
| | | Co | (ppm) | Not detected | 2 | Not detected | Not detected | 6 | Not detected |
| | | Ti | (ppm) | Not detected | Not detected | Not detected | 8 | Not detected | 5 |
| | | Al | (ppm) | Not detected | Not detected | 4 | Not detected | 2 | 12 |
| | | P | (ppm) | Not detected | 3 | Not detected | 3 | Not detected | 1 |
| | | Total impurities | A-B (ppm) | 22-177 | 27-172 | 44-188 | 38-172 | 37-181 | 64-199 |
| Properties | Tensile strength ($N/mm^2$) | | | 393 | 399 | 387 | 368 | 413 | 429 |
| | Elongation (%) | | | 1.1 | 1.9 | 1.4 | 2.5 | 1.5 | 1.4 |
| | Conductivity (% IACS) | | | 98.1 | 98.1 | 98.2 | 96.6 | 96.1 | 97.3 |
| | Heat resistance | Vickers hardness (HV) | Before heating ($HV_0$) | 126 | 127 | 118 | 108 | 131 | 135 |
| | | | After heating ($HV_1$) | 119 | 112 | 109 | 102 | 125 | 118 |
| | | $HV_1/HV_0$ | | 0.94 | 0.88 | 0.92 | 0.94 | 0.95 | 0.87 |
| | Average crystal grain size (μm) | | Before heating | 12 | 13 | 13 | 18 | 12 | 11 |
| | | | After heating | 56 | 28 | 22 | 22 | 20 | 18 |

※1: S(sulfer) to P (Phosphorus) are the elements detected in any of the examples

TABLE 3

| | | Com. Ex. 1 | Com. Ex. 2 | Com. Ex. 3 | Com. Ex. 4 | Com. Ex. 5 | Com. Ex 6 | Com. Ex. 7 |
|---|---|---|---|---|---|---|---|---|
| Production method | Casting | High-frequency melting furnace | High-frequency melting furnace | High-frequency melting furnace | High-frequency melting furnace | High-frequency melting furnace | High-frequency melting furnace | High-frequency melting furnace |
| | Thickness of test piece | 20 mm | 20 mm | 20 mm | 20 mm | 20 mm | 20 mm | 20 mm |
| | Heating | 950° C. | 950° C. | 950° C. | 950° C. | 950° C. | 950° C. | 950° C. |
| | Hot-rolling (thickness after rolling, reduction ratio) | 3.6 mm, 82% | 3.6 mm, 82% | 3.6 mm, 82% | 3.6 mm, 82% | 3.6 mm, 82% | 3.6 mm, 82% | 3.6 mm, 82% |
| | Cold-rolling (thickness after rolling, reduction ratio) | 1 mm, 72% | 1 mm, 72% | 1 mm, 72% | 1 mm, 72% | 1 mm, 72% | 1 mm, 72% | 1 mm, 72% |
| | Recrystallization-annealing | 400° C. × 30 min | 400° C. × 30 min | 400° C. × 30 min | 400° C. × 30 min | 400° C. × 30 min | 400° C. × 30 min | 400° C. × 30 min |
| | Final cold-rolling (thickness after rolling, reduction ratio) | 0.5 mm, 50% | 0.5 mm, 50% | 0.5 mm, 50% | 0.5 mm, 50% | 0.5 mm, 50% | 0.5 mm, 50% | 0.5 mm, 50% |
| | Low temperature annealing | None | None | None | None | None | None | None |

* Com.Ex. = Comparative Example

TABLE 4

| | | | Com.Ex. 1 | Com.Ex. 2 | Com.Ex. 3 | Com.Ex. 4 | Com.Ex. 5 | Com.Ex. 6 | Com.Ex.7 |
|---|---|---|---|---|---|---|---|---|---|
| Alloy composition of copper | Cu | (mass %) | Balance | Balance | Balance | Balance | Balance | Balance | Balance |
| | Ni | (mass %) | Not detected | 0.1500 | 0.0200 | 0.0100 | 0.0600 | 0.0100 | 0.0003 |

TABLE 4-continued

| | | | | Com.Ex. 1 | Com.Ex. 2 | Com.Ex. 3 | Com.Ex. 4 | Com.Ex. 5 | Com.Ex. 6 | Com.Ex.7 |
|---|---|---|---|---|---|---|---|---|---|---|
| alloy sheet material | Sn | | (mass %) | 0.0200 | 0.0100 | Not detected | 0.1500 | 0.0600 | 0.0100 | 0.0003 |
| | Ni + Sn | | (mass %) | 0.0200 | 0.1600 | 0.0200 | 0.1600 | 0.1200 | 0.0200 | 0.0006 |
| | C | | (ppm) | 42 | 34 | 33 | 18 | 26 | 27 | 39 |
| | O | | (ppm) | 42 | 32 | 28 | 29 | 19 | 58 | 47 |
| | H | | (ppm) | 1.2 | 1.4 | 1.8 | 1.7 | 1.1 | 1.3 | 1.2 |
| | Ag | | (ppm) | 16 | 14 | 20 | 21 | 15 | 12 | 10 |
| | Impurities ※1 | S | (ppm) | 10 | 10 | 10 | 10 | 10 | 10 | Not detected |
| | | Mg | (ppm) | Not detected | 4 | 2 | 5 | Not detected | 8 | 2 |
| | | Fe | (ppm) | 3 | 2 | Not detected | 2 | Not detected | 80 | Not detected |
| | | Zn | (ppm) | Not detected | Not detected | 8 | Not detected | 5 | 8 | 5 |
| | | Si | (ppm) | 2 | Not detected | Not detected | 6 | Not detected | Not detected | Not detected |
| | | Co | (ppm) | Not detected | Not detected | 2 | Not detected | 6 | 12 | 2 |
| | | Ti | (ppm) | Not detected | 4 | Not detected | Not detected | 3 | 7 | Not detected |
| | | Al | (ppm) | 5 | Not detected | Not detected | 2 | 2 | Not detected | 3 |
| | | P | (ppm) | 2 | Not detected | 5 | Not detected | Not detected | 50 | Not detected |
| | | Total impurities | A-B (ppm) | 22-157 | 20-174 | 27-171 | 25-169 | 26-179 | 175-317 | 12-166 |
| Properties | Tensile strength ($N/mm^2$) | | | 396 | 383 | 376 | 441 | 428 | 403 | 374 |
| | Elongation (%) | | | 1.3 | 3.6 | 1.8 | 1.9 | 1.9 | 2.1 | 2.5 |
| | Conductivity (% IACS) | | | 98.9 | 88.6 | 98.7 | 87.3 | 91.8 | 91.1 | 100.0 |
| | Heat resistance | Vickers hardness (HV) | Before heating ($HV_0$) | 127 | 122 | 120 | 138 | 131 | 131 | 119 |
| | | | After heating ($HV_1$) | 82 | 118 | 66 | 123 | 123 | 123 | 59 |
| | | $HV_1/HV_0$ | | 0.65 | 0.97 | 0.55 | 0.89 | 0.94 | 0.94 | 0.50 |
| | Average crystal grain size (μm) | | Before heating | 14 | 13 | 13 | 11 | 11 | 11 | 15 |
| | | | After heating | 121 | 16 | 118 | 23 | 21 | 45 | 150 |

* Com.Ex. = Comparative Example

※1: S(sulfer) to P (Phosphorus) are the elements detected in any of the examples

CONCLUSION

Examples 1 to 6 show the copper alloy sheet material containing 0.0005% by mass or more and 0.1% by mass or less of Ni, 0.0005% by mass or more and 0.1% by mass or less of Sn, 100 ppm or less of C, 800 ppm or less of O, 10 ppm or less of H, and 50 ppm or less of Ag, with a balance being Cu and impurities, wherein a total content of Ni and Sn is 0.001% by mass or more and 0.11% by mass or less, and when a content of the impurities are expressed as A to B (ppm) in consideration of a quantitative lower limit of a measuring device (here, A is a total impurity content when a content of an element less than the quantitative lower limit is deemed 0 ppm, and B is a total impurity content when a content of the element less than the quantitative lower limit is deemed the quantitative lower limit of each element), A is 100 or less and B is 250 or less. This copper alloy sheet material exhibits excellent properties in a property evaluation by measuring the tensile strength, elongation, Vickers hardness, conductivity, heat resistance, and crystal grain size.

The invention claimed is:

1. A copper alloy sheet material, containing 0.0005% by mass or more and 0.1% by mass or less of Ni, 0.0005% by mass or more and 0.07% by mass or less of Sn, 100 ppm or less of C, 800 ppm or less of O, 10 ppm or less of H, and 50 ppm or less of Ag, with a balance being Cu and impurities, wherein a total content of the Ni and the Sn is 0.001% by mass or more and 0.11% by mass or less, when a content of the impurities are expressed as A to B (ppm) in consideration of a quantitative lower limit of each element (here, A is a total impurity content when a content of an element less than the quantitative lower limit is deemed 0 ppm, and B is a total impurity content when a content of the element less than the quantitative lower limit is deemed the quantitative lower limit of each element), A is 100 or less and B is 250 or less, and the copper alloy sheet material has a conductivity of 96 to 102% IACS.

2. The copper alloy sheet material according to claim 1, containing 1 to 50 ppm of S.

3. The copper alloy sheet material according to claim 1, wherein an average crystal grain size of the copper alloy sheet material is 1 to 30 μm.

4. The copper alloy sheet material according to claim 1, wherein a ratio ($HV_1/HV_0$) of Vickers hardness $HV_1$ after holding the copper alloy sheet material at 350° C. for 5 minutes in the atmosphere, with respect to Vickers hardness $HV_0$ of the copper alloy sheet material before holding, is 0.80 or more.

5. The copper alloy sheet material according to claim 1, wherein the copper alloy sheet material has an average crystal grain size of 100 μm or less after being held at 800° C. for 1 hour.

6. A heat dissipating part in which the copper alloy sheet material of claim 1 is used.

7. An electronic part in which the copper alloy sheet material according to claim 1 is bonded to an insulating substrate.

8. A method for producing a copper alloy sheet material, comprising:

applying hot-rolling to a copper alloy; then, applying cold-rolling to the copper alloy;

applying recrystallization-annealing to the cold-rolled copper alloy; then, applying final cold-rolling to the copper alloy, the copper alloy containing: 0.0005% by mass or more and 0.1% by mass or less of Ni, 0.0005% by mass or more and 0.07% by mass or less of Sn, 100 ppm or less of C, 800 ppm or less of O, 10 ppm or less of H, and 50 ppm or less of Ag, with a balance being Cu and impurities, wherein a total content of the Ni and the Sn is 0.001% by mass or more and 0.11% by mass or less, when a content of the impurities is expressed as A to B (ppm) in consideration of a quantitative lower limit of each element (here, A is a total impurity content when a content of an element less than a quantitative lower limit is deemed 0 ppm, and B is a total impurity content when a content of the element less than the quantitative lower limit is deemed the quantitative lower limit of each element), A is 100 or less and B is 250 or less, and the copper alloy sheet material has a conductivity of 96 to 102% IACS.

* * * * *